US006256939B1

(12) United States Patent
Snyder

(10) Patent No.: US 6,256,939 B1
(45) Date of Patent: Jul. 10, 2001

(54) SUPPORT MEMBER FOR A FLOOR BEAM OF A BUILDING

(76) Inventor: William S. Snyder, P.O. Box 5236, Klamath Falls, OR (US) 97601

( * ) Notice: Subject to any disclaimer, the term of this patent is extended or adjusted under 35 U.S.C. 154(b) by 0 days.

(21) Appl. No.: 09/413,168

(22) Filed: Oct. 7, 1999

(51) Int. Cl.[7] ..... E04B 9/00
(52) U.S. Cl. ..... 52/126.6; 248/354.3
(58) Field of Search ..... 52/126.5, 126.6; 248/354.1, 354.3

(56) References Cited

U.S. PATENT DOCUMENTS

| | | | | |
|---|---|---|---|---|
| 2,548,844 | * | 4/1951 | Myers | 248/354.3 X |
| 3,222,030 | * | 12/1965 | Thorpe | 248/354.3 X |
| 3,398,933 | * | 8/1968 | Haroldson | 248/354.3 X |
| 3,870,268 | * | 3/1975 | Larkin | 248/354.1 |
| 4,122,645 | | 10/1978 | Tooley | 52/648 |
| 4,558,544 | * | 12/1985 | Albrecht et al. | 52/126.6 |
| 4,761,924 | | 8/1988 | Gustafson | 52/126.6 |
| 4,914,875 | | 4/1990 | Gustafson | 52/126.6 |
| 5,588,264 | | 12/1996 | Buzon | 52/126.6 |
| 5,590,863 | * | 1/1997 | Sasaki | 248/354.3 |
| 5,862,635 | * | 1/1999 | Linse et al. | 248/354.3 X |

* cited by examiner

*Primary Examiner*—Peter M. Cuomo
*Assistant Examiner*—Stephen Vu
(74) *Attorney, Agent, or Firm*—James D. Givnan, Jr.

(57) ABSTRACT

Upper and lower tubular components of the support members are in threaded engagement for beam support. Retainer cups secure the support member in place while a lock seats about the upper and lower components to prevent rotation after installation. An opening in the upper tubular component permits charging of the support member with concrete or other reinforcing agent.

13 Claims, 1 Drawing Sheet

SUPPORT MEMBER FOR A FLOOR BEAM OF A BUILDING

BACKGROUND OF THE INVENTION

The present invention concerns the use of a manufactured support assembly for the floor beam of a home or other building and which is adjustable to various heights of beams from a supporting surface.

In many areas of the country it is a common building practice to utilize wooden posts or piers for the support of floor components of a house or other building. The post must be cut at a precise length to accomplish such support and typically must be of a good grade of lumber preferably treated with a preservative. While use of wooden posts has been accepted practice for many years the ever increasing shortage of suitable wood for such posts has resulted in significant cost increases for such lumber. Further, the man hour effort expended in installing such posts including dimensioning same, contributes to the costly use of same. Further, wooden posts for floor supports in certain parts of the United States are not desirable in view of pests such as termites and/or environmental conditions. A further drawback to the use of wooden beams is that over long periods of time wooden supports are subject to shrinkage requiring replacement or shimming of the posts. Wooden posts also are susceptible to dry rot which necessitates post replacement.

In the prior art, U.S. Pat. No. 4,122,645 discloses a scaffold supporting pole having a base member and a stem on which a nut element with hand grips is carried which positions an intermediate plate relative a top plate used to support scaffolding.

U.S. Pat. Nos. 4,914,875 and 4,761,924 disclose a beam support member utilizing a threaded foot on a base plate and a cylinder slidably housed by upright supports The support member is of welded construction U.S. Pat. No. 5,588,264 discloses a floor support having threaded internal and external members adjustable to selected heights with spacers and drains on the internal member to separate and vent the slabs supported on the internal member.

U.S. Pat. No. 5,862,635 discloses a support structure for a building beam or foundation having a base in which is positionably received an inner member adjustable by insertion of a bolt and is further adjustable with the inner member threadedly engaged with the base for minute adjustments.

SUMMARY OF THE PRESENT INVENTION

The present invention is embodied within an adjustable support member for convenient installation beneath a floor beam of a house or other structure.

The present support member includes axially adjustable tubular members with provision for vertical adjustment of one of said members into beam engagement. A lock is provided which serves to secure the members against rotation therebetween with the lock being embodied, in one form, in a collar engageable with both members by use of a locking compound. Provision is made for charging of the support member with a quantity of fluidized material such as concrete which upon setting contributes to the enhance missing text strength of the support member as the added material virtually occupies the length of the support member.

Important objectives include the provision of a beam support of synthetic material for use during construction in houses and buildings which reduces the effort and costs heretofore incurred in the installation of wooden post supports; the provision of a beam support member of low cost synthetic materials and of tubular construction which may receive a reinforcement agent during installation; the provision of a support member having adjustable components which, upon adjustment; are joined by locking means preventing relative movement between the components; the provision of a support member or pier for supporting floor beams and of a material not susceptible to rust, dry rot, fungi or termites.

DETAILED DESCRIPTION OF THE PREFERRED EMBODIMENTS

Figure 1:
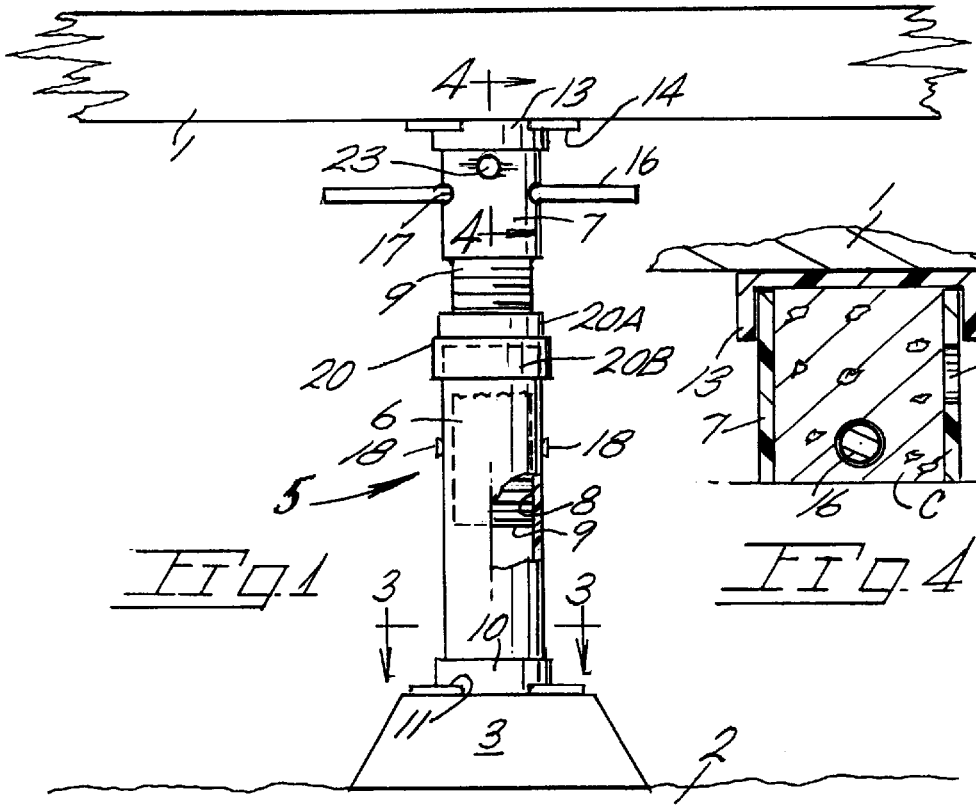
FIG. 1 is an elevational view of the present support member installed in place supporting a beam.

With continuing attention to the drawings wherein applied reference numerals indicate parts similarly hereinafter identified, the reference numeral 1 indicates a beam of a house or other building structure vertically spaced from a ground surface 2 which may be soil or a poured slab. A footing is at 3.

The present support member or pier is indicated generally at 5 and includes lower and upper tubular components at 6 and 7 threaded respectively at 8 and 9. A suitable material for members 6 and 7 is polyvinylchloride pipe.

Figure 4:
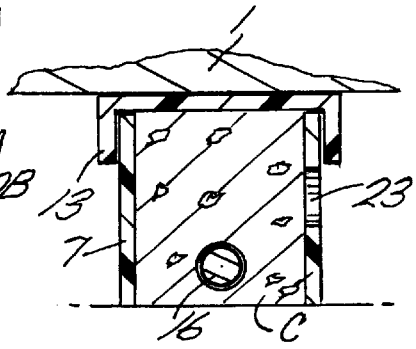
FIG. 4 is a vertical sectional view taken along line 4—4 FIG. 1.
Figure 2:
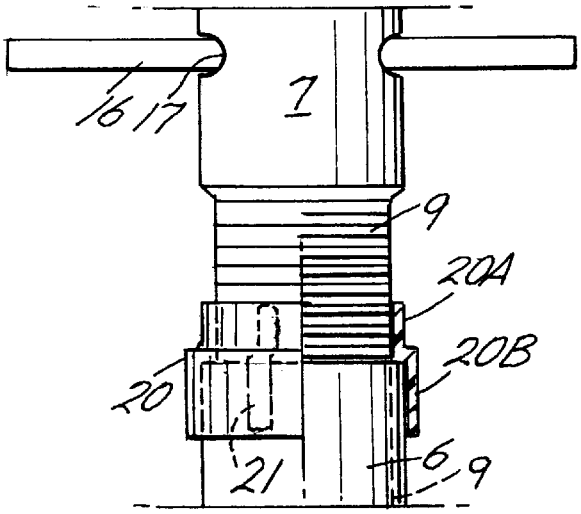
FIG. 2 is an enlarged fragmentary view of the support member with fragments broken away.
Figure 3:
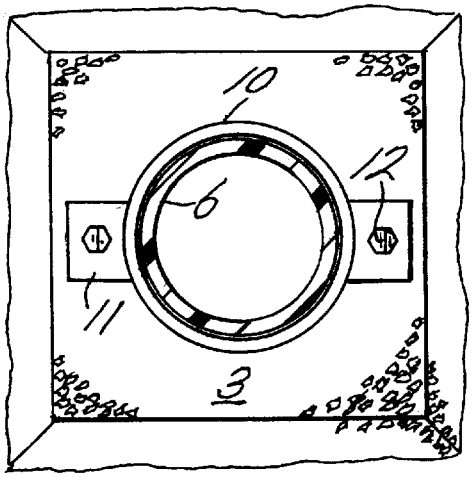
FIG. 3 is a horizontal sectional view taken downwardly along line 3—3 of FIG. 1.

The lower end of tubular component 6 is received within a retainer ring 10 of cup shape defining a recess which having flanges at 11 for the reception of fasteners at 12 (FIG. 3) which penetrate footing 3. A similar retainer ring 13 has a recess which receives the upper end of tubular component 7 and has flanges at 14 for securement, as by fasteners, to beam 1. Retainer ring 13, as best shown in FIG. 4, is of invested cup configuration.

A bar at 16 is insertable through aligned openings 17 in upper tubular component 7 to enable imparting rotation and vertical adjustment of upper component 7 relative to tubular component 6 upon manual effort being applied to bar 16.

Locking means, in one form of the invention, includes screws at 18 inserted within aligned pilot openings drilled in the tubular component 6 and 7, to prevent further rotation of tubular component 7. In those installations where it is desirable to avoid drilling of apertures in the tubular components for reception of screws 18, preferred locking means including a collar at 20, preferably of polyvinylchloride is utilized and includes a first portion 20A having an internal wall corresponding to the outside diameter of threaded portion 9 of component 7. Integral with portion 20A is a second collar portion 20B having an internal wall of a diameter corresponding to the outside diameter of tubular component 6. A sealant or other compound at 21, compatible with the synthetic material of components 6 and 7, such as a sealant for joining pipes of synthetic material is applied to threads 9 of the upper member 7 and also to the upper end segment of component 6 which sealant or compound, upon setting, serves to lock the collar 20 to the components to prevent subsequent rotation therebetween in the preferred form of the invention as it obviates the drilling of pilot holes and installation of locking screws 18. The collar 20 may also be formed from polyvinylchloride. To enable the application of the compound or sealant, collar 20 is momentarily lifted to expose the upper end segment of component 6 as well as the adjacent threaded portion on tubular component 7 followed by repositioning of the collar as shown in FIG. 1.

In those installations of the present support member where anticipated loads necessitates reinforcement of support members it is desirable to provide an opening 23 in upper tubular component 7 to permit the charging of the support member with a fluid, reinforcing agent such as concrete. Such charging of the support member is a final step in those installations where added strength is required of a permanently installed support member.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A support assembly for supporting a beam of a building structure, said support assembly comprising:

upper and lower tubular components of a synthetic material, each having interengaged threaded segments to permit adjustment of their combined length, retainer rings receiving opposite ends of said tubular components and confining the components against lateral displacement, one of said tubular components rotatable confined within one of said retainer rings, means for imparting rotation to said one of said tubular components, and locking means for preventing rotational movement between said tubular components.

2. The support assembly claimed in claim 1 wherein said locking means includes a collar initially slidably disposed about adjacent segments of said tubular components.

3. The beam support assembly claimed in claim 2 wherein said locking means includes a sealing compound for sealing pipes of synthetic material between said collar and said tubular components.

4. The beam support assembly claimed in claim 2 wherein said collar is formed of a synthetic plastic, said locking means including a sealing compound disposed between said tubular components and said collar having a plurality of inside diameters.

5. The support assembly claimed in claim 1 wherein one of said retainer rings includes an end wall.

6. The beam support assembly claimed in claim 1 additionally including a fluid reinforcing agent occupying said upper and lower tubular components.

7. The beam support assembly claimed in claim 6 wherein said fluid reinforcing agent is concrete.

8. The beam support assembly claimed in claim 6 wherein one of said tubular components is constructed to receive the fluid reinforcing agent.

9. A support assembly for use in construction of a dwelling to support a floor beam, said support assembly comprising, upper and lower tubular components of a synthetic plastic material having interengaged threaded segments to permit adjustment of their combined length, retainer rings each confining an opposite end of the tubular components, one of said opposite ends rotatable within one of said retainer rings, means for attaching said retainer rings respectively to a floor beam and to a surface below the dwelling, means for imparting rotation to one of said tubular components, and locking means for preventing rotational movement between said tubular components.

10. The support assembly claimed in claim 9 wherein said tubular components are formed from polyvinylchloride pipe.

11. The support assembly claimed in claim 9 wherein said locking means includes a collar is placed about said tubular members, wherein a compound is applied to said tubular components and to said ring, and said collar having a plurability of inside diameters.

12. The support assembly claimed in claim 9 additionally including a reinforcing agent occupying said tubular components.

13. The support assembly claimed in claim 12 wherein said reinforcing agent is concrete, wherein one of said tubular components defines an aperture to receive concrete.

* * * * *